US008708868B2

(12) United States Patent
Partlo

(10) Patent No.: US 8,708,868 B2
(45) Date of Patent: Apr. 29, 2014

(54) FIGHTING ARTS SHIELD LIKE DEVICE

(76) Inventor: Loren George Partlo, Coleman, MI (US)

( * ) Notice: Subject to any disclaimer, the term of this patent is extended or adjusted under 35 U.S.C. 154(b) by 182 days.

(21) Appl. No.: 13/462,309

(22) Filed: May 2, 2012

(65) Prior Publication Data

US 2013/0296141 A1 Nov. 7, 2013

(51) Int. Cl.

| | |
|---|---|
| ***A63B 71/00*** | (2006.01) |
| ***A63B 69/32*** | (2006.01) |
| ***A63B 69/34*** | (2006.01) |
| ***A63B 69/26*** | (2006.01) |

(52) U.S. Cl.
USPC ..... 482/88; 482/84; 482/8

(58) Field of Classification Search
USPC ..... 482/1, 8, 9, 83, 84, 87, 88, 90; 273/440.1; 473/441–445
See application file for complete search history.

(56) References Cited

U.S. PATENT DOCUMENTS

| | | | | |
|---|---|---|---|---|
| 2,994,534 | A * | 8/1961 | Davis et al. | 473/444 |
| 4,088,315 | A * | 5/1978 | Schemmel | 482/4 |
| 4,546,966 | A * | 10/1985 | Segura | 482/88 |
| 4,763,284 | A * | 8/1988 | Carlin | 702/41 |
| 5,281,191 | A * | 1/1994 | DeSousa | 482/83 |
| 5,501,649 | A * | 3/1996 | Queppet | 482/88 |
| 5,899,809 | A * | 5/1999 | Landa Cosio | 463/8 |
| D410,986 | S * | 6/1999 | Luedke et al. | D21/798 |
| 5,971,398 | A * | 10/1999 | Broussard et al. | 273/408 |
| 6,925,851 | B2 * | 8/2005 | Reinbold et al. | 73/12.09 |
| 6,942,585 | B1 * | 9/2005 | Krause | 473/445 |

* cited by examiner

*Primary Examiner* — Oren Ginsberg
*Assistant Examiner* — Garrett Atkinson

(57) ABSTRACT

A fighting arts shield like device designed to be carried or mounted. Through hitting the apparatus the contestant can condition and develop muscles and technique. The device may be either solid or hollow. The shield front is specifically developed to represent striking areas found on a human target and developed such that a properly delivered strike will land solidly; improper or techniques delivered from the wrong distance will not land appropriately. The backside is uniquely developed with features that enhance the holder's ability to hold and direct the shield thereby enhancing its utility. The shield is carried in a boxing on-guard position. The shield like device may have an optional electrical component that allows measurements to be made of the speed, power and force vectors of strikes where data may be instantaneously presented by audio and visual indicators or disaggregated or used at a later date.

17 Claims, 10 Drawing Sheets

FIG. 3.5

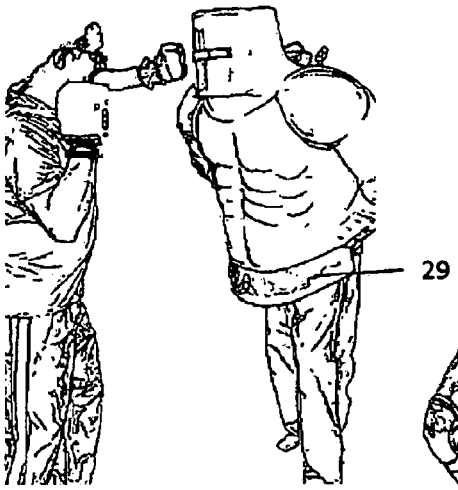
FIG. 12
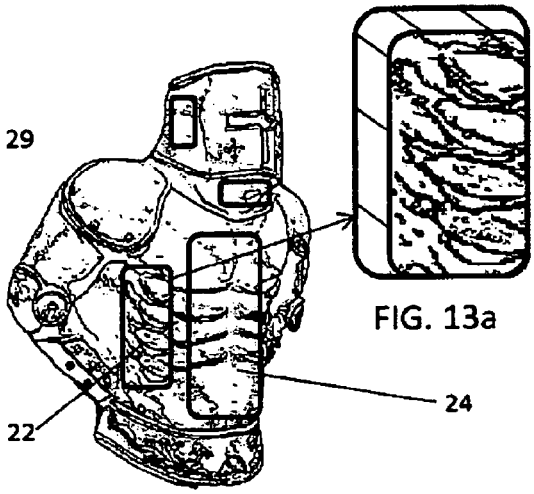
FIG. 13a
FIG. 13
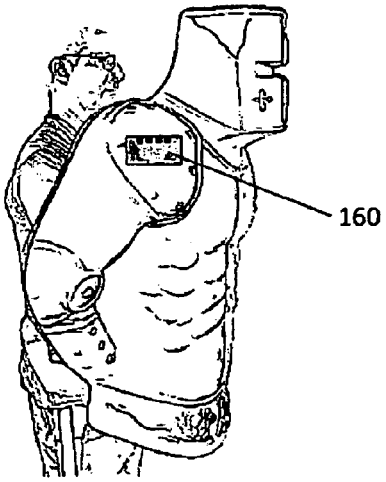
FIG. 14a
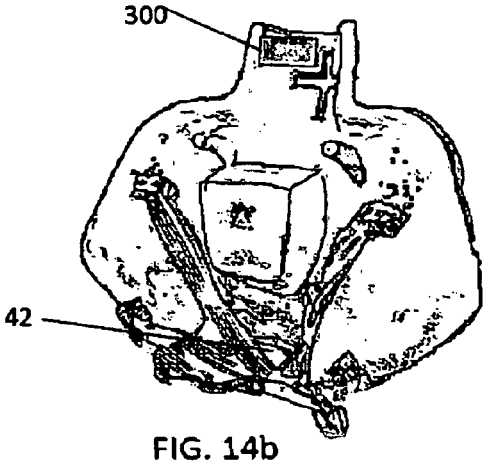
FIG. 14b

FIGHTING ARTS SHIELD LIKE DEVICE

CROSS-REFERENCE TO RELATED APPLICATIONS

| U.S. Patent Documents | | |
|---|---|---|
| 2,574,046 | November 1951 | Logan |
| 2,994,534 | August 1961 | Davis et al. |
| 3,759,515 | September 1973 | Crooks |
| 3,896,497 | July 1975 | Rhee |
| 4,478,408 | October 1984 | Bruckner |
| 4,546,966 | October 1985 | Segura |
| 4,889,334 | December 1986 | Pardo |
| 4,974,833 | December 1990 | Hartman et al. |
| 4,991,231 | February 1991 | Swift |
| 5,009,414 | April 1991 | Bass |
| 5,209,691 | May 1993 | Ekstein |
| 5,232,368 | August 1993 | Morgia |
| 5,254,062 | October 1993 | Hoffman |
| 5,277,679 | January 1994 | Wells |
| 5,281,191 | January 1994 | DeSousa |
| 5,362,289 | November 1994 | Holt |
| 5,458,552 | October 1995 | Mara |
| 5,542,667 | August 1996 | Lezdey et al. |
| 5,501,649 | March 1996 | Queppet |
| 5,582,561 | December 1996 | Gonzalez |
| 5,605,336 | February 1997 | Gaoiran et al. |
| 5,723,786 | March 1998 | Klapman |
| 5,741,970 | April 1998 | Rubin |
| 6,258,013 | July 2001 | Dabney |
| 6,925,851 | August 2005 | Reinbold et al. |
| 0,216,228 | November 2003 | Rast |
| 0,258,515 | November 2006 | Kang et al. |
| 7,308,818B2 | December 2007 | Considine et al. |
| 7,909,749 | March 2011 | Sheedy |
| 8,011,222 | September 2011 | Wilber |
| 8,029,422B2 | October 2011 | Stong et al. |

Primary Examiner:
Assistant Examiner:
Attorney, Agent or Firm: Loren G. Partlo

STATEMENT REGARDING FEDERALLY SPONSORED RESEARCH OR DEVELOPMENT

Not applicable

FIELD OF THE INVENTION

The present invention relates to fighting arts such as boxing, martial artists or mixed martial artists practice devices designed to be struck and used to train and improve a fighter's technique and ability to apply said technique with multiple embodiments of which may also provide data collection on impact measurements with associated systems to analyze compare and use data for interactive and real-time training methods using multimedia electronic devices and software.

BACKGROUND OF THE INVENTION

In the course of training within the fighting arts there are a number of activities used by the coach to improve the striking skills of the contestant. The training events usually focus on the development or implementation of a single technique or a combination of blows. For example a heavy bag is a piece of equipment used as a training aid to develop power within a strike. Each training aid has inherent limitations so several types of equipment are generally used within the development of one technique, or an aspect thereof. The heavy bag in this example is used to develop power but it is limited in scope of use because of its restricted range of movement and its predictable pendulum motion. In order to train distance and timing, another important aspect of technique application coaches generally use a variety of hand held targets such as focus mitts in order to incorporate movement and distance training into the workout. Using focus mitts or hand held targets require the coach to work a predetermined routine with the fighter to maintain the coach's safety. Additionally, because of focus mitts small nature they cannot be held firmly for full contact engagements without risking damage to the holder. A great deal of force is generated and transmitted directly to the coach and this provides an environment for the coach to be injured. The current invention seeks to fill the gap between such training devices by providing a target that can be hit full force to develop power like a heavy bag, yet is portable so the coach can also incorporate distance and timing training into the workout without the need for limiting the training to coordinated routines to maintain the safety of the coach.

One of the most difficult tasks in training a fighter is getting the fighter to apply the same technique in practice as he/she uses in the heat of a contest. The goal is to get the fighter to practice the way they compete then identify the fighter's skill level and improve upon their performance. The coach's ability to do this is limited due to their ability to be an active participant in the training process and the ability to quantify individual strikes and or quantify individual strikes within a combination set. Sparring with another fighter with the coach watching and providing comment is the current standard. The coach in this perspective is an observer providing direction from the perspective of a bystander. This limits the scope of the coach's ability to experience the actual technique of the person being trained. When the coach has the ability to hold the target they receive information about the power, timing, angle and penetration of a strike. The current invention is designed to allow the coach to be a participant not just a bystander and to do so safely. Certain embodiments of the invention also allows the coach the ability to quantify individual strikes to assess angle of attack, penetration and power of each strike allowing for continuity in the assessment of performance and with the data derived from the assessment prepare training and improve individual performance from a data based perspective not merely the passive perspective of experience.

Another novel idea found within the current invention is the development of the intended striking area(s). The development of the striking area is done with intent to receive perspective attacks with the proper angle of attack as it relates to the striking surface. This is referred to as contouring throughout this document. Proper contouring is important regarding proper angle of attack the two are interrelated with respect to distance. The striking areas are contoured or shaped/developed so if the attack is performed properly and from the proper distance the strike lands solidly. For example the faceted striking areas on the head like projection of the current invention are angled such that in a moving environment if the attacker fails to be close enough when delivering a hook to the head the attack will slip off the intended target because the distance between the target and the attacker has changed the angle of attack on the striking surface. If the hook is done from the proper distance the angle of attack will be proper and the hook will land solidly.

Other inventions may have an area they have termed as a striking areas or an area upon a pad identified as a striking zone but none provide a planed contact surface development; none have multiple developed or contoured/faceted striking areas designed with or accidently having the aforementioned development. Additionally, this invention is novel because the shield like design combines the multiple striking areas in a logical pattern matching perspective target areas of a person with dedicated safety features (belt like band, side projections, and vision port). This combination of novel features allow for a safe environment where the coach can be a participant and provide instant feedback while hosting the opportunity for realistic un-choreographed combinations done with full speed and power.

Engaging an assortment of target types is beneficial in the development of a fighter. Until the current invention there has been no target that provides multiple contoured target areas in multiple axis that allows for application of technique as one would against an opponent. To engage a moving target that has the same general target areas, movement abilities (because of its portability) that can be safely utilized by an experienced or a beginner brings a new dimension to training that will allow the fighter to strike as they would in a real contest, instinctively and without prior coordination with the target holder. No other individual piece of equipment currently in existence allows for this level of built in safety or experience.

Another novel design of this invention has multiple features that create a developed backside of the shield like device consisting of: protruding handles, belt like bands, chest contact pedestal, bracing points, a wall mount attachment point, a vision port and a safety space between the holder's face and the back of the target. No other inventions have such features.

Additionally, another novel design feature is that the shield like device has a multitude of embodiments. The unique front and backside features can be manufactured into a shield made of foam or foam with a support structure similar in construction to existing foam shields on the market. However, creating a plastic or metal hollow structure that has the ability insert resilient force absorbent material onto the contoured striking areas is a totally new design concept within the field. This feature creates a lighter, more resilient target that provides multiple embodiments of construction.

Additionally, a novel concept of the invention is that it has dedicated safety features. No other previous targets have built in safety features not intended to strike but to protect the holder.

Consistency in the power of a strike and the timing of the blow in sequence is another important aspect of training that is difficult to assess and currently, outside of the current invention, there are no multiple striking area targets with human spatial striking comparison that offer a contoured target area coupled with digital capture of data regarding the power, direction and or speed of a technique. The current invention is novel in that it is a shield like device with multiple contoured striking areas that provides an interactive training experience and depending upon the embodiment would be able to provide a full range of interactive performance assessments providing an option to capture data and provide audio, video feedback and the ability to work and or display video and data performance on your personal computer, internet or other electronic device that uses digital data. This will allow for an in-depth disaggregation of data, and a new level of managing and assessing training performance.

DESCRIPTION OF THE RELATED ART

Striking pads and devices have been used in the practice of martial arts, boxing and fighting sports for thousands of years. Such devices have been designed to be held or affixed to a support structures or another article of equipment with desired intent to focus on various aspects of improving performance. Within the last few years inventors have started incorporating devices to collect performance data.

Illustrative of prior art that is relate to (mobile) hand held mitt type targets are described below.

U.S. Pat. No. 3,896,497 [Rhee] The Rhee patent describes an energy absorbing focus glove device into which an instructor's hand is inserted. The device described in the Rhee patent is constructed of two (2) circular pads made of resilient foam. The invention provides two flat target areas, one on each side of the hand.

U.S. Pat. No. 4,478,408 [Bruckner] The Bruckner patent describes a similar mitt that is also made of resilient foam material for absorbing energy. The Bruckner mitt covers the hand and wrist (as a safety feature) and has a contoured crosspiece projecting from one side within the pad that allows a person to grip the interior of the pad.

U.S. Pat. No. 4,991,231 [Swift]. The Swift patent describes another mitt type target that is made in the shape of a human head. The target is made of a resilient material to allow for force absorption and protection of the person hitting and holding the target. The resilient material head-mitt is the target. There are no contoured features or development of the intended striking area. The Swift target represents one of the first inventions to provide a human like target idea with a striking pad idea.

Illustrative of prior art that is relate to an adjustable target(s) are described below.

U.S. Pat. No. 4,111,415 [Reitano] The Reitano invention is a striking practice-aid device used in martial arts training which displays a single solid rubber square target attached by straps to an adjustable pole. This practice aid is not something that can be held and moved as the student strikes. It is a stationary device vertically adjustable with no other utility or intent.

Illustrative of prior art that relates to targets that provide a hard target of some design such as a board holding device or simulated breaking board that has a defined striking area are described below.

U.S. Pat. No. 5,232,368 [Morgia] The Morgia invention is designed with a striking area defined by removable flexible guides that assist in defining the target area that contains a resilient strike board target within a single target area. The flexible guides are not intended to be struck. Feedback is provided when striking the target if one or more of the wedge shaped guides detach from the target.

U.S. Pat. No. 5,254,062 [Hoffman] The Hoffman invention is similar to that of Morgia in that it is a kick-board type target that has a single defined striking area with the addition of suction cups to affix it to an appropriate surface so it can be used by an individual.

U.S. Pat. No. 5,362,289 [Holt] The Holt patent is actually a frame that can be hand held or mounted to a wall that holds a board within a defined striking area. Although it is portable it is designed for a single focused strike.

U.S. Pat. No. 4,889,334 [Partlo] The Partlo patent is a board holding device that has an adjustable pedestal design or can be hand held, or placed against a wall that holds one or more boards to create a single hard target designed for power breaking. The expanding throat feature allows for improved safety of the person breaking the board(s).

Illustrative of prior art that relates to targets that have multiple defined target areas and are "non-resistant contact" meaning, minimal force is returned to the practitioner on contact with the target are described below.

U.S. Pat. No. 8,029,422B2 [Strong et al.] The Strong patent is a flexible sheet of plastic like material with a target drawn on it. Multiple targets can be placed on a sheet that is suspended before the practitioner or several sheets can be presented at one time. The targets are not contoured, they are graphical flat representations printed upon a flexible sheet that has multiple embodiments (hanging configurations) and holding options.

Illustrative of prior art that relate to targets that are shield like in nature are described below.

U.S. Pat. No. 2,574,046 [Logan] The Logan patent is a dummy/shield invention designed for football training. The dummy/shield is concave in shape, made of a resilient material, inflatable and portable with an outer covering that has straps type handles. The device is contoured with one intended striking surface. It does not have a mount option; it is not intended to be affixed to a stationary object or pedestal in any fashion. The device is designed to be pushed against as one would expect to find in the practice of football.

U.S. Pat. No. 2,994,534 [Davis et al] The Davis et al. patent is a similar football practice device with one intended striking area. It is similar in nature to the design of Logan being portable, resilient, inflatable and having a covering with sewn on attached handles; however, the primary difference being an enlarged opening through the center of the practice device intended to allow partial penetration of a football helmet thereby reducing potential neck injuries. Due to its positioning the opening cannot be used nor was it intended to be used as a vision port.

U.S. Pat. No. 5,009,414 [Bass] The Bass patent is described as football shield like device used as a diagnostic tool. Although it is portable the device is not made for striking but for pushing against. As a diagnostic tool it has no electronic quantifiable data gathering capability or processes or options thereof. As a diagnostic tool it simply allows the coach to watch and based upon their experience make recommendations for improvement.

There have been shield like targets that have been hand held intended for the fighting arts such as the ones mentioned below.

U.S. Pat. No. 6,258,013 [Dabney] The Dabney patent is a protective martial arts target pad that has a target area that is defined by two parallel protrusions that extend out toward the user similar to the Morgia patent only the Dabney patent protrusions do not detach. They assist in defining a limited and restricted target area by creating a box effect that the user strikes into with the intent of not touching the guide like protrusions. This is considerably different than the current invention's contoured target areas intended to replicate the target areas of a person. The protrusions in the Dabney patent are not intended to be targets but guides that define and accentuate the target element on the padded surface intended to receive the strike. The protective target apparatus is made of an energy-absorbing material with griping straps so it can be held.

U.S. Pat. No. 4,546,966 [Segura] The Segura patent is a padded plate that is moderately convex and is flanked at the sides and top with obliquely forwardly projecting wings that help focus the boxers blows to the central portion. The wings may be struck with various types of blows at various angles being both a target and protection to the holder. The invention uses a set of bandolier-like straps and a pair of sewn on handles secured to the backs of the side portion wings. The invention unlike the current invention does not have "solid handles" affixed to the back side of the device that allows for the holder to hold the target in a boxing on-guard stance. Additionally, the Segura patent lacks the backside developments of the current invention by not having contoured bracing points, a chest pedestal, or built in handles (not straps) that work in conjunction with the bandoleer like straps to secure the shield like device to improve handling. Furthermore, the current invention has purposely designed contoured and faceted striking areas and dedicated safety features such as the belt like band and the protective side/rear-facing protrusion that provide protection to the holder that are not intended to be struck.

U.S. Pat. No. 5,501,649 [Queppet] The Queppet patent is a shield constructed of a striking board covered with a pad having planar board like areas to the front and each side which are flat. The striking areas are the entire board like surfaces that are not contoured nor does the Queppet patent have developed, contoured striking areas or a developed backside. The Queppet patent is similar in this respect to the Segura patent where the striking surface is also the protective surface. The invention in no way attempts to replicate or present targets similar in position or type to replicate a human target.

U.S. Pat. No. 5,281,191 [DeSousa] The DeSousa patent is a striking dummy that is a sculptured three-dimensional target intended to anatomically resemble a human torso with head. The invention is made of a resilient protective outer layer to prevent injury or damage to the striking dummy or user. The dummy has a foam core and straps configured with the intent to strap the dummy to a punching bag. This invention was not designed or manufactured to be carried or used as a shield. Furthermore, the striking dummy does not have contoured designed striking areas, it is a soft upper torso replication of a person that is designed to be struck anywhere.

Illustrative of prior art that is relate to devices that gather impact data from glove worn sensors during sparring competitions are discussed below.

U.S. Pat. No. 6,925,851 [Reinbold et al.] The Reinbold patent presents a system for data gathering of force impacts during a competition between contestants wearing gloves that have wireless impact sensing components. The current invention only gathers data of forces delivered to specific contoured striking areas and not designed for use as a striking item.

U.S. Pat. No. 5,723,786 [Klapman] The Klapman patent is " . . . a novel boxing glove impact measuring system." The current inventions interactive workout and data management components are integrally reliant upon association with one or more of the areas to be struck on the shield like device. These areas passively measure impact where the Klapman and Reinbold patents measure data on actively used objects used to strike.

Illustrative of prior art that is related to devices that have impact measuring devices imbedded within their design as passive targets.

U.S. Pat. No. 5,741,970 [Rubin] The Rubin patent works off a " . . . pressure sensor which communicates with the impact receiving section . . . " this is only possible if the system is imbedded within the Rubin " . . . cell foam layer . . . " device presented as being imbedded within a single target. The current invention data gathering system does not utilize a pressure sensor and the current inventions interactive workout and data management components are integrally reliant upon association with one or more of the embodiments of the shield like device that has multiple contoured striking areas.

U.S. Pat. No. 0,258,515 [Kang et al.] The Kang et al. patent target is described as . . . "impact receiving body is formed in the approximate shape of at least part of a torso and is supported by a platform . . . " furthermore having illuminated indicators mounted in association with the impact sensors. The aforementioned target unlike any embodiment of the current invention does not have a portable configuration nor does it have defined contoured target areas designed with intent to represent target areas of a humanlike adversary.

Additionally, the current invention does not co-locate associate impact sensors with illumined indicators. Similar to the current invention it has an interactive software package that is solely associated with its individual invention.

Illustrative of prior art that is related to devices that have impact measuring devices imbedded within their design with visual indicator for queuing the user to strike an identified area where the sensor is located.

U.S. Pat. No. 7,909,749 [Sheedy] The Sheedy patent is a heavy bag or may in a different embodiment be a cover with impact sensors that are attached to a heavy bay that are associated with visual indicators for queuing the user(s) on where to strike. The heavy bag target provides the object to be hit while the sensors collects data from the strike for comparison. The current invention impact sensors cannot be removed or placed on another piece of equipment, the sensors are associated only with the shield device.

Illustrative of prior art that relates to devices that have impact data sensors that may be attached to an object are discussed below. These devices can be used in any number of sports to include attachment to targets struck for the fighting arts.

U.S. Pat. No. 5,605,336 [Gaoiran et al.] The Gaoiran et al. patent is . . . "a shock sensor that is attached to an athlete or a target such as a punching bag." The device is an independent impact-sensing measuring system not associated with a particular piece of equipment but capable of . . . "evaluating athletic performance even if the athlete does not contact a target or another object . . . " The current inventions interactive workout and data management components are integrally reliant upon and are only associated with one or more of the embodiments of the shield like device and cannot be removed to be used on another piece of equipment.

U.S. Pat. No. 0,216,228 [Rast] The Rast patent is for a Portable Biofeedback system that has sensors that can be attached to a boxing bag, golf club, tennis racquet, or multi-cylinder strength training device which . . . "converts impact and training rates into audio streams following human speech patterns". The current inventions interactive workout and data management components are integrally reliant upon association with one or more of the embodiments of the shield like device.

U.S. Pat. No. 7,308,818B2 [Considine et al.] The Considine et al. patent like the Rast patent is a fitness device of great utility that works with hard wire or wireless impact-sensors and associated software. The Considine device allows for digital data interpretation, management and feedback use with audio and visual indicators for real-time use however, the sensors are portable and can be affixed to any object be it a bag, target; a golf club or bat and data is derived from the impact sensors attached thereof. The Considine et al. device can also be used to assess power and trajectory of golf balls, baseballs, footballs or similar projectiles by attaching the impact-sensing portion of the system to the target impacted making it useful in diagnosing the associated swings and throwing actions producing the resultant readings. The current inventions interactive workout and data management components are integrally reliant upon association with one or more of the embodiments of the shield like device with limited utility designed to only be used with the shield like device. The data collection transmission package is not designed or intended to be removed or used on a different piece of equipment.

U.S. Pat. No. 8,011,222 [Wilber] The Wilber patent is another portable impact detection device that was designed for use by martial artists that is placed on or within a target with appropriate padding between the user and the sensor. The sensor allows for impact data to be captured and transmitted to a computer and feedback to be given to the user by means of light signal. The current invention data collection processes are associated only with the shield like device and not removable for use on other equipment.

Devices currently on the market without patent marking are discussed below.

There are on the market currently four devices not listed within the patent archives that pertain to this patent.

Century Martial arts "Sparring Bob" is for all intensive purposes the same invention as U.S. Pat. No. 5,281,191 [DeSousa] only the sparring dummy "Sparring Bob" is attached to a water filled portable pedestal, "Sparing Bob" is not designed to be removed from the pedestal or to be strapped to a heavy bag. The device is not intended to be carried or mounted to any other object besides the hollow associated pedestal. Although it presents an anatomical torso type target it does not have contoured defined striking areas enhanced in shape, as does the current invention; nor does it have any embodiment that works with collecting force data or workout feedback.

The second invention similar to "Sparring Bob" is from Everlast the "Everflex Freestanding Sparring Partner". It is made of shock absorbing foam and is shaped to some extent like a human torso meaning there is a head like portion but it is unlike the current invention in design or intent. The "Everflex Freestanding Sparring Partner" does not provide contoured striking areas. The "Everflex Freestanding Sparring Partner" is designed with the intent of not having definition and therefore has no contoured defined target areas, the entire invention is designed to be struck anywhere. It is not mobile, has no mounting attachment point(s) and is not intended to be used as a shield. Like "Sparring Bob" it is attached to a plastic water filled portable base that under heavy impact can be knocked over and it does not re-right itself. Like "Sparring Bob" the "Everflex Freestanding Sparring Partner" does not have an associated data collecting and or management system.

The third invention is the TITLE MMA Ground & Pound Training Dummy that is a block shaped dummy, constructed of a tough coated canvas to practice throws, slams, strikes, jabs, punches, kicks, knee strikes, submission holds etc. It has a fiber fill core and is constructed of a high density foam liner to help the dummy keep its shape and offer resistance yet resiliency for penetrating strikes. MMA grappling dummies are force absorbent targets and often provide realistic size and weight. These training targets are not intended to be used as shields or carried and no data collection options are associated.

The fourth invention is the Title MMA Opponent Training shield. The invention is four foot long and resembles half of a cylinder. It has a notch in the top similar to a castle wall that allows the person holding the shield to see the opponent while having limited face protection. The curvature of the cylinder protects the holder's upper torso in addition to providing a striking surface for the attacker. The device is made of a multi-layered foam covered with a synthetic leather cover and handles are sewn to the fabric to allow the person to hold the bag. There are also adjustable back straps that can be placed around the holder's back and legs. It is an invention without defined striking areas, has sewn strap handles, hand placement is up but not in a proper on-guard boxing stance, there are no constructed brace points, chest pedestal or impact force measuring data package options.

Several differences between prior art and the current invention have been noted. The current invention is novel in that provides a contoured striking areas designed so a proper strike will land with decisive impact and an improper thrown technique will slide off due to the design of the contoured striking area. Furthermore no prior art presents a target with multiple contoured target areas nor are any purposely designed with the striking areas in similar pattern to striking areas of a human target. Further, the prior art does not have a device designed to be portable and also having a mounting option. None have a specific vision port(s) through their invention that allows the holder visibility while being safely behind the target. None describe a comprehensive ergonomic holding system made of multiple supports as does the current invention with said chest contact pedestal, brace points, bandoleer(s) attachment(s) and built in handles. None have dedicated safety features, not intended to be struck, that protect the holder. Additionally, there is nothing in the prior art that provides the novel shield like design with embodiments to provide options of aforementioned target uniqueness with application of impact-sensing, data collecting and digital information handling processes required for an interactive workout like the current invention.

Thus, the present invention with its various embodiments is novel as a device providing a uniquely designed multiple target array with dedicated safety features, unique vision port(s), a unique holding and support system that may be combined with a digital data package only associated with the current invention to allow precision measurements to be taken and analyzed with: force, speed and time measurements combined with video and associated software to create a real-time interactive workout and process for designed workouts with features that can be integrated with wire and wireless digital devices also able to be accessed on individual, networked or digital multi-media devices that may also place data on the internet.

None of the aforementioned inventions and patents, singly or in combination, are seen to describe the instant invention as claimed.

SUMMARY OF THE INVENTION

This invention relates to a fighting arts (martial arts, boxing, mixed martial arts) shield like device comprising of a multitude of defined target areas similar in shape to a human torso. The shield like device has twelve embodiments constructed of various types of materials and or combinations thereof with and without impact measuring data management packages.

Contoured striking area: The idea of a contoured striking area is novel to this invention. The development of the striking area is done with intent where the striking area is developed to receive perspective attacks with the proper angle of attack with respect given to the striking surface, so if the attack is performed properly the strike lands solidly. The development of the striking area includes: creation of a surface with intent, the surface may be flat but have a specific angle or a curvature that can be convex or a concave providing a particular angle on the surface to be struck with respect to how the target is held, or the creation of facet like faces on the contact area or a combination of the aforementioned. Other inventions have striking areas but their terminology intent is to simply identify locations to be hit, none provide this type of contact surface development when defining the striking area. Existing art simply does one of three things; it firstly presents a surface on a force absorbent material that can be struck anywhere. Second identifies an area to be struck may be identified by an image that may or may not have texture in the nature of a picture, or bull's-eye on the object to be struck. Thirdly, enhancements such as projections around the area are created that help define the area. None have single or multiple developed or contoured/faceted striking areas developed for proper angle of attack. Additionally, this invention is novel because of the shield like representation combining the multiple striking areas in a logical pattern similar in location to the target areas of a person.

Head-like-protrusion: The shield like device has a head like protrusion that has developed angular target areas designed to be met at a 90 degree angle when proper technique is applied. Additionally, the head like striking area is set forward of the other striking areas to provide a safety space buffer between the face of the holder and the back side of the head like protrusion. The back of the head like protrusion is hollowed to improve safety clearance between the holder and the attacker. The head like protrusion is also offset forward of the other striking areas to purposefully create an extended chin like striking area.

Chin-like striking area: The chin like striking area has an elevated slope, a convex or concave base portion and two extended halves (left and right) that are flat with slight outward-upward angle when viewed from the front and extended to provide a robust chin contact area with a defined striking area developed to provide a solid horizontal shelf that permit uppercuts or kicks appropriate contact area.

Shoulder-like protrusions: The shield like device has shoulder like protrusions that assist in defining the separation between the head like striking area and the central striking area which is below the shoulder like protrusions. The central striking area consisting of a midsection chest/stomach like surface area that is contoured similar in nature to a male human chest meaning, it has a small flat section that widens towards the distil edges of the target then curves at each side like a normal chest/stomach area of a human being to form two bilaterally symmetrical ribcage like striking areas that are laterally located off each side and perpendicular to the central striking area.

Ribcage-like striking areas: The ribcage like striking areas; each are formed laterally off the curving back edges of the central striking area, are contoured to provide a curvature for striking to provide a target that if properly struck will be met at a 90 degree angle. The rear edges of the ribcage like striking area(s) stop at the barrier formed by the side projection(s). The bottom of the ribcage-like striking areas stop at the top of the Belt like band.

Side projections: In order to maintain safety for the holder two bilaterally symmetrical side projections extend to the side and rearward, behind the intended striking areas of the shield like device while being outside of and away from the striking areas so as not to interfere with a proper attack. The side projections are a safety feature not intended as a striking surface. Each side has a single side projection that protects the holder should a strike miss the ribcage-like striking area.

Hand held moving target: The shield like device is intended to be mobile, a hand held moving target with a multitude of contoured target areas forming a target array for the attacker while also providing safety for the holder where attacks can be done full force allowing the holder to easily adjust height and/or distance of the target to be struck during the training session.

Vision port(s): The shield like device has at least one vision port available so the person carrying the shield like device can observe the attacker(s) at close proximity, without risk of receiving a blow to the head or body. The vision port(s) is a slot(s) or opening through the shield like device and or a clear portion of the shield like device integrally manufactured or affixed to the shield that will allow vision from the backside of the shield through the shield itself to observe the attacker(s).

The intent is to be able to have visibility through the shield itself. If the entire outer edge of the shield like device were constructed of a clear plastic the clear area would constitute a vision port or window.

Central mount attachment point: The shield like device has a central mount attachment point that allows the shield like device to be affixed to a stationary object such as a wall, post, beam or other fixed point in a room so an individual can use the shield like device without a holder.

Chest contact pedestal: The shield like device has a chest contact pedestal which is ergonomically built into the back side of the shield like device allowing the holder to increase his/her chest surface contact area with the shield like device to allow for better shield control, stability and rigidity to hold the shield device under powerful blows or thrusts from the attacker(s).

Bracing points: The bracing points are ergonomically constructed below and on each side of the arm channel. The bracing points are also the back contours where the attachments points are shown. The arm channel(s) are below the handles that allow the holder to comfortably embrace the shield like device with their chest against the pedestal with their arms comfortably under the handles. The arm channels(s) are the hollows in the back side of the shield where the arms go and the bracing points are the inside and outside sides of the arm channels. These areas have been designed and spaced such that the holder can comfortably push against the shield like device with the inside/outside portions of his/her forearms. The bracing points which are the large curves in the back side of the shield like device next to the attachment points are also bracing points designed so that when embodiments of the shield that are made of resilient foam type material flex under powerful repetitive strikes and flex back toward the holder, the holder can lean against these bracing points with their upper-torso and or shoulders, while holding the shield like device so the holder can increase body contact with the shield like device to brace the target and hold it steady.

Handles: The handles within the design this invention are such that they allow the holder to grip the shield like device similar to the form of a boxing on-guard-stance. The handles are not sewn on to the device but instead are affixed solid entities that are griped with the palm of the hands facing in and the hands make a first around the handle. They are laterally positioned with regard to the vertical plane of the device. This is an important aspect of the shield because the holder is then in a boxing on-guard-stance, this is unique to all past and current devices. This feature allows the muscles that one uses in a boxing on-guard-stance to be developed as the holder receive blows and strikes on the shield like device. This feature enhances the functionality of the shield like device by providing a training benefit to the holder as well as providing familiarity of movement and using already developed muscles for the experienced coach.

Positive pressure: this is a unique aspect of the shield like device achieved by the strapping configuration. When Bandoleer type straps are combined with properly placed attachment points the holder when lashed to the shield can use the straps to push outward as a boxer would when fending off blows. This outward pushing constricts the straps and places an outward or positive pressure that significantly improves holding ability when combined with the chest pedestal and other shield backside unique holding developments.

Attachment points: The shield like device has built in attachment points for adding one or more unique support strap(s) or bandoleer type straps that will go all the way around the holder's torso allowing him/her to lash themselves to the shield like device to assist the holder in supporting the invention and improve his/her ability to stabilize, support and better control the shield. The location of the Attachment points are critical for the bandoleer type strap placement to provide proper positive pressure when being held.

Bandoleer type straps: The benefit of the bandoleer type straps that go around the torso are that if set properly the holder can push against them and increase stability for some types of strikes with a positive outward pressure.

Accessory attachment points: Additional equipment attachment points are manufactured into the shield like device at various locations to allow the holder a flat defined space to attach additional devices (notes, timers etc.) to the shield like device to assist the coach in running a productive training session.

Belt like band: The belt like band is a protective barrier at the base of the central striking area and rib like striking areas and connects to the distil edges of each of the side projections allowing protection for the crotch, upper legs, and torso of the holder.

Plurality of defined target areas: The shield like device presents a plurality of defined target areas that can be struck in any combination without need of prior coordination of attacks while providing striking areas in all axis available for multiple successive attacks which allows the shield like device to provide a full contact workout that also can incorporate distance and timing drills while maintaining the safety of the holder.

The current invention may be found with or without a data collection process. When the invention is found with a data collection component it will have a data collection transmission package. The data collection transmission package exists within the body of the shield like device that collects data and transmits it via wire or wirelessly to one of two types of data management systems. The data collection transmission package consists of but is not limited to a central processing unit (CPU), one or more digital impact sensor(s), a 120-volt power supply AC/DC converter and or a self-contained battery pack, a Data Device Memory, Random access memory (RAM), and a wire or wireless transmission component so it can communicate with the on-board integrated impact data device package or the detached data management pylon.

The on-board integrated impact data device package is a grouping of electronic components imbedded within the shield like device having: digital communication (wire and or wireless) to the data collection transmission package. The on-board integrated impact data device package is designed to communicate with audio and visual devices for use with digital software to provide feedback audio and visual components (data display and light array) to create a real-time interactive training device where impact data can be; transmitted to, stored, tracked, compared and used by other digital electronic systems and devices to include an individual's computer, internet or other digital medium. The on-board integrated impact data device package is solely associated with the shield like device having but not limited to the following components: central processing unit (CPU), one or more digital impact sensor(s), one or more video modules, one or more speaker units, one or more digital data display's, a 120-volt power supply AC/DC converter and or a self-contained battery pack, a Data Device Memory, Random access memory (RAM), Light emitting diode display (LED's), "MMC (multimedia card) attachment. "USB" (universal serial bus) attachment, a Auxiliary Plug which will provide multiple plug in options such as input jacks for audio, video equipment, heart monitoring equipment, etc. This attachment point is to support various technologies for wire transfer of data, Wireless card adapter, and Flash card port. Note that the on-board integrated impact data device package also communicates with the backside and user side data displays.

The detached data management pylon receives data from the data collection transmission package and any other auxiliary devices such as cameras or microphones. If the gym buying the shield like device wants to have multiple shield(s) like devices an embodiment will be chosen with a front and backside user data display and a data collection transmission package that will transmit data to the detached data management pylon. The data will then be transmitted from the pylon to the gym computer. Data will also be sent to the backside and user side data displays. This will allow the coach and the user to get audio and light data at their respective shield like device while collecting data at the detached data management pylon. This is important if there are multiple shield like devices in use in the same gym. The detached data management pylon has all the same components as the on-board integrated impact data device package. Because the Detached data management pylon receives data from the data collection transmission package and other auxiliary devices and is not on the shield like device there is less of a chance for component failure due to repetitive shock. The detached data management pylon is capable of receiving and managing data from multiple shield(s) like devices. This provides the ability of the gym to have multiple shield(s) like devices in use at the same time and have all the data collected (via wire or wirelessly) and compiled at the detached data management pylon before it is sent to a central computer wire or wirelessly to interface on line with other users and or compare or manage data.

The simplest use of the interactive function for interactive training would be a simple audio tone and or colored light associated with a power reading that would initiate when the shield like device is struck. If the person hitting the shield does not want to read the digital numeric reading that would be displayed on the user and backside data display and pylon he/she could see the color light indicator that would provide a visual indication of if the power was on (green), above (blue) or below (red) the preset. The light array associated with a contoured striking area is not one where the user punches after seeing a light indicator. Meaning you don't strike the light in a sequence as a prompt found in a game. The color lights are associated with a force vector and or reading to let the person striking the target be able to see if they are hitting the target with the optimal force and or vector. The person would also be able to hear a tone with the same type of association. A more complex use would be a constructed interactive data program where encouragement would be given over the speaker system to the user with pre-set audio feedback based on the power or speed reading of a particular technique or combination (i.e., "jab, cross, jab"—"Good combination!" if the readings are over the desired pre-set powers for the technique) in a real-time feedback mode.

The complexity of the software management program allows the user to have a data driven real-time interactive training session with the shield like device. This software program is up-datable to improve methods of tracking, managing, storing and integrating the use of personal and web based data options. One advantage to having a preset interactive program is that when the shield like devise is mounted and a person is practicing alone the interactive audio and light array can be arranged to use as a prompt for a training session designed by an experienced coach. Or a set routine can be created and the coach could control the workout from the backside of the shield like device with the user data display that would provide a name of a combination to be worked on then a bell tone with time countdown to assist the coach and or the participant in the management of the workout.

The data management processes can be configured into a number of various assessment modes. One example would be to have an audio asking for a particular technique ("do three jabs when you hear/see the start indicator) then cataloging an average of the impact forces captured for the technique to give the person hitting the average speed and power they just struck with. The data assessment would also provide a method for identifying an individual so they could compare data over time and with the video attachment feature and with the proper software the person could take video of themselves via the video attachment port and catalog their performance for review later or share digitally with others on the internet. This feature would allow a detailed review of technique with the power and speed data so an experienced coach could make critique and or provide review of the technique at various speeds and or the participant could do a self review.

When a person is going to use a embodiment of the shield with the data package they can identify themselves by number, an alpha numeric sequence, a magnetic card or if equipped with software and microphone by verbal command.

The idea of the data collection transmission package is to provide an electronic digital data collection and management system that is integrally associated with the shield like device to easily quantifying training and monitor improvement of training with a mobile or mountable shield like device that has multiple embodiments of various types of material to better fit the multitude of art forms, purposes of and types of training activities coaches want to use to develop individual striking ability.

The data management software at the computer terminal would be able to receive information from one or multiple shield like devices. Because each individual is identified each workout will be catalogued under an individual calendar based workout program. The program would be able to not only track speed, power and combination type done but also if the user implements the heart rate monitor the time in the target heart range of the workout could also be displayed along with other information such as the calories burned etc. Because the data is centralized the software will also be able to provide gym statistics for the day, month and year. An example would be the average amount of punches thrown in a day, the amount of target heart rates reached, the duration of time the target heart rate zone was held and or the average caloric burn for the gym for the day. The average number of strikes over or above a preset threshold is another example of comparison category for a gym. In this way gyms could compare themselves to other gyms on line as will the individual contestants. The on line component is important to be able to provide a larger pool of statistical competition for the individual and the gym. In this way an individual could be recognized within their fighting art category, age, weight and experience bracket for having the hardest, quickest or best combination of the day. Also categories such as boxers, martial artist or MMA competitors could compare their stats against others in their sport on line.

There are twelve embodiments of the shield like device each provides the aforementioned qualities and features. The differences between the embodiments are the types of material the shield like device is made of and the lack of or addition of an impact measuring device package. The first six embodiments do not have a data collection (impact measuring device package) feature.

The first embodiment is manufactured out of a leather or canvas cover stuffed force absorbent stuffing as traditionally found in punching bags with or without interior support structure.

The second embodiment is manufactured out of a resilient force absorbent foam or layers thereof with or without exterior covering.

The third embodiment is made out of resilient force absorbent foam with a sheet of flexible plastic core material within the foam body to provide additional interior support and reduce the force absorbance of the shield like device while providing interior strength to the device with or without exterior covering.

The fourth embodiment is made out of a hard non-force absorbent material with a hollow interior with or without exterior covering.

The fifth embodiment is made of a hard non-force absorbent material; with a foam filled portion between the front and back walls of the shield like device to increase the rigidity and durability of the device to be able to withstand heavy impacts with or without exterior covering.

The sixth embodiment is any of the previously detailed embodiments with or without exterior covering having: removable force absorbent contoured striking areas that can be replaced if torn, damaged or worn out.

The seventh embodiment is manufactured out of a leather or canvas cover stuffed with force absorbent material as traditionally found in punching bags with or without interior support structure with a data collection transmission package that will communicate digitally with either the on-board integrated impact data device package or the detached data management pylon.

The eighth embodiment is made out of resilient force absorbent foam like material with or without exterior covering with a data collection transmission package that will communicate digitally with either the on-board integrated impact data device package or the detached data management pylon.

The ninth embodiment is made out of resilient force absorbent foam with a sheet of flexible plastic core material within the foam body with or without exterior covering with a data collection transmission package that will communicate digitally with either the on-board integrated impact data device package or the detached data management pylon.

The tenth embodiment is made out of a hard non-force absorbent material with a hollow between the front and back of the shield like device with or without exterior covering with a data collection transmission package that will communicate digitally with either the on-board integrated impact data device package or the detached data management pylon.

The eleventh embodiment is made of a hard non-force absorbent material that is foam filled between the front and back with or without exterior covering with a data collection transmission package that will communicate digitally with either the on-board integrated impact data device package or the detached data management pylon.

The twelfth embodiment is any of the previously detailed embodiments with or without exterior covering having: removable force absorbent contoured striking areas that can be replaced if torn, damaged or worn out with a data collection transmission package that will communicate digitally with either the on-board integrated impact data device package or the detached data management pylon

BRIEF DESCRIPTION OF THE SEVERAL VIEWS OF THE DRAWING

For the purpose of illustrating the invention, there is shown in the drawings forms which are presently preferred; it being understood, however, that the invention is not limited to the precise arrangements and instrumentalities shown.

FIG. 3.5 is a perspective left side view of the shield like device on a mounting device.

FIG. 12 is a perspective front view of the fifth embodiment depicting the shield like device created of a hard non-force absorbent material; with a foam filled portion between the front and back of the shield like device.

FIG. 13 is a perspective right front view of the sixth embodiment depicting the shield like device created of a hard non-force absorbent material with removable contoured striking areas that can be replaced if torn, damaged or worn out.

FIG. 13*a* is a perspective view of the removable contoured striking area of the sixth embodiment that can be replaced if torn, damaged or worn out.

FIG. 14*a* is a perspective front view of the eighth embodiment depicting the shield like device being held that is created out of a resilient force absorbent foam like material with a data collection transmission package and on-board integrated impact data device package showing the front data display with light array.

FIG. 14*b* is a perspective back view of the eighth embodiment depicting the shield like device created out of a resilient force absorbent foam like material with a data collection transmission package and on-board integrated impact data device package showing the holder data display with light array.

DETAILED DESCRIPTION OF THE INVENTION

Figure 1:
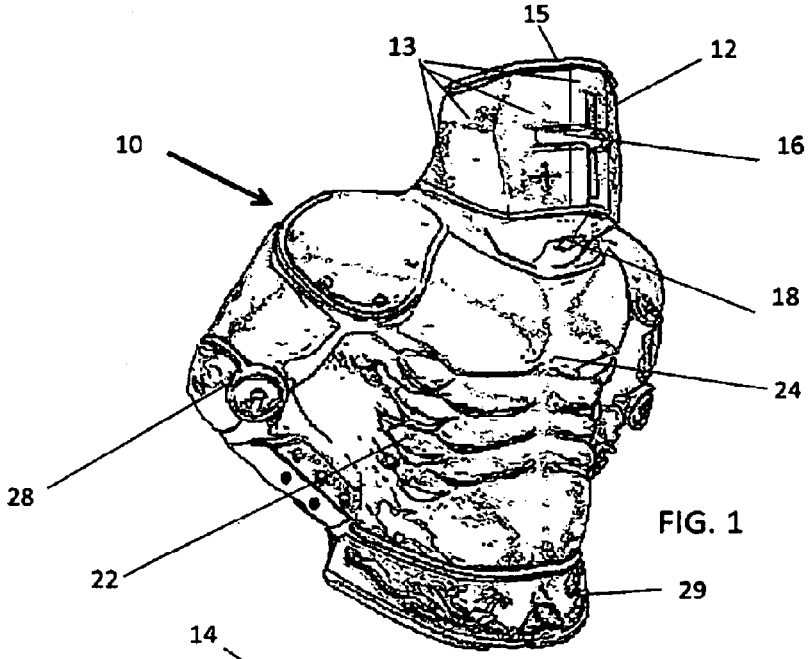
FIG. 1 is a perspective right side view of the shield like device.

The description is not intended to be limiting, it is made solely for the purpose of illustrating the principles of the invention. The striking training aid depicted of the present invention is a device which resembles the torso of an armored knight. The invention could be made to resemble any number of items i.e., space alien, monster, samurai, tough-guy etc. The invention will however maintain the set construct principles as defined within this document. There are twelve embodiments of the invention based on the material of construction and the addition or lack of a force measurement package. The twelve variations will be discussed in depth with association to the figures.

Referring now to the drawings in detail, where like numerals refer to like parts or elements, there is shown the shield like device depicted as an armored knight 10, further displayed in related FIGS. 1-16. Each of the various figures or components of the shield like device 10, are described as follows.

As shown in FIG. 1 the shield like device 10 includes a target area similar in shaped to a knights helmet this is the head like protrusion 12 having faceted areas in the front and sides 13 specifically designed to receive properly delivered attacks at a 90 degree angle thereby providing a planed and defined target area that due to the impact of the blow will provide instant feed-back to the person hitting the target as to if they are hitting properly. Wherein, if the attacker is not hitting properly their attack will slip off the target not making effective contact.

Figure 2:
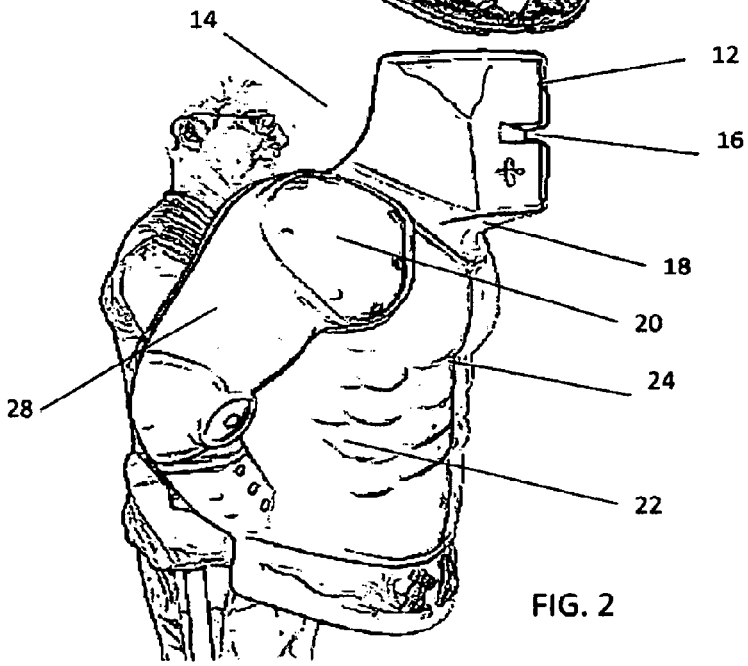
FIG. 2 is a perspective view of the shield like device being carried.

As shown in FIGS. 1 and 2 The head like protrusion 12 also has at least one vision port(s) 16 vertical and or horizontal or a combination one or more thereof that provides vision forward and to the sides allowing the coach to carrying the shield like device and be able to observe the attacker(s) at close proximity, without risk of receiving a blow to the head or body. The vision port(s) 16 is a slot(s) through the shield like device or a clear portion of the shield like device integrally manufactured or affixed to the shield that will allow vision from the backside of the shield through the shield itself to observe the attacker(s).

The head like protrusion 12 is positioned anterior of the central body portion of the shield like device. This provides a space 14 shown in FIG. 2 between the face of the holder and the interior of the head like portion 12 of the shield like device 10 as seen in FIG. 2. This space 14 provides a safety buffer so that as the shield is held the holder will have adequate reaction time when the shield like device is violently struck to allow the holder to be able to keep their head from making a whip-lash type movement and contacting the shield like device.

Figure 3:
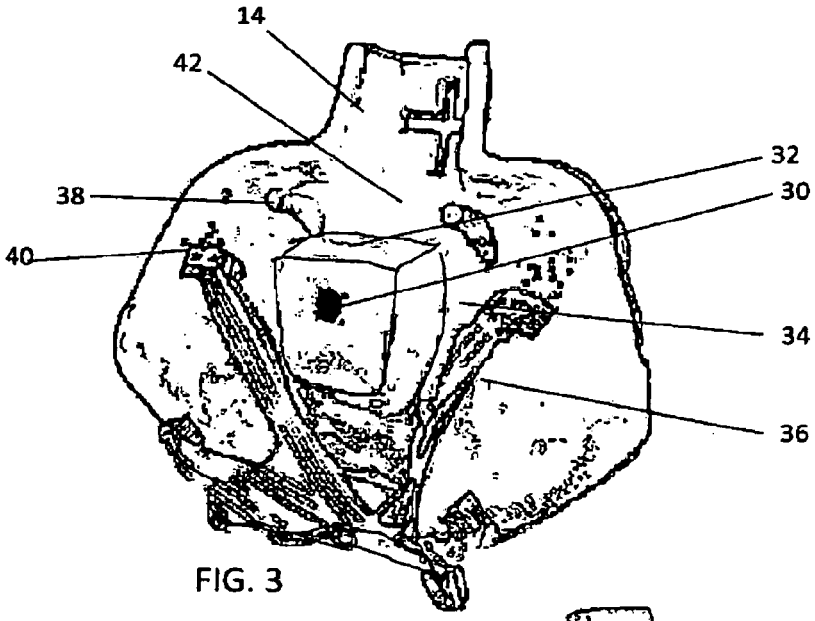
FIG. 3 is a perspective back view of the shield like device.
Figure 7:
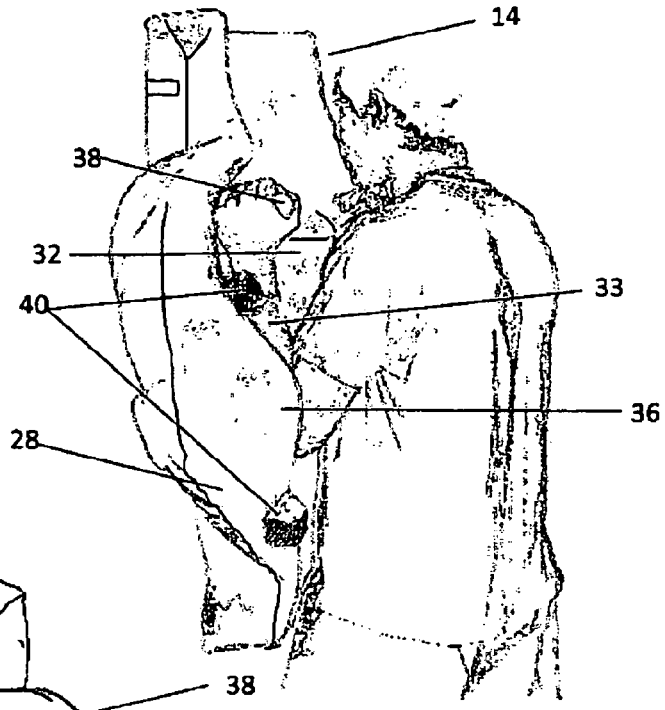
FIG. 7 is a perspective back left side view of the shield like device being held without bandoleer straps.
Figure 8:
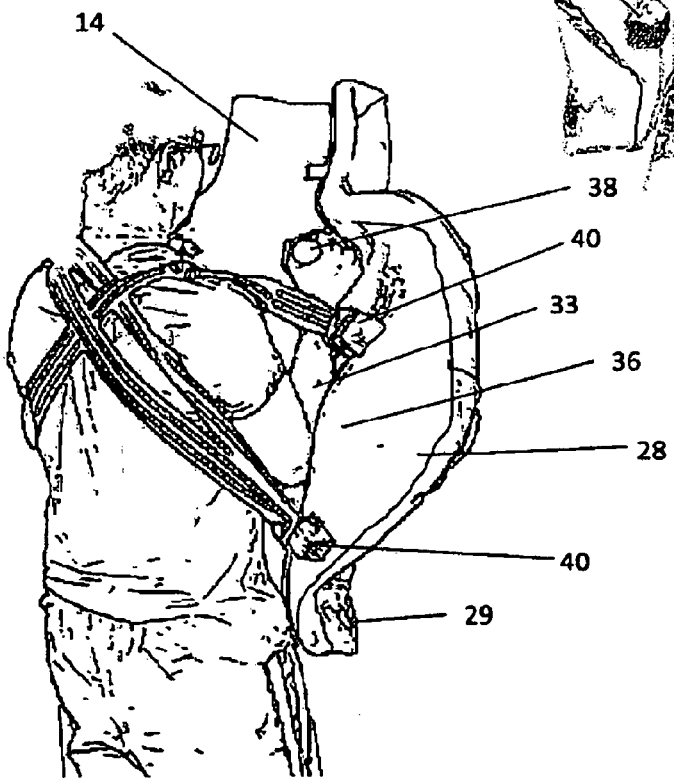
FIG. 8 is a perspective back right side view of the shield like device being held with bandoleer straps.

As seen in FIGS. 3, 7 and 8, the back of the head like protrusion 12 is concave in design and wide enough to enhance the space 14 to provide adequate space and safety for the face of the holder should it move forward so it will not contact the back side of the head like protrusion.

Figure 4:
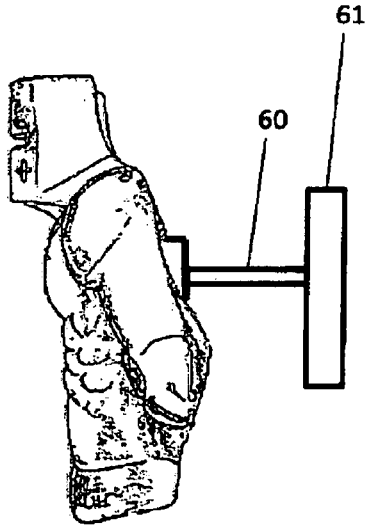
FIG. 4 is a perspective left side view of the shield like device being carried.
Figure 4:
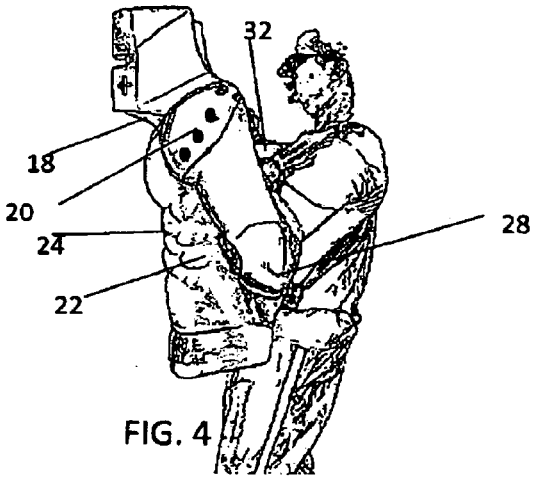
Figure 5:
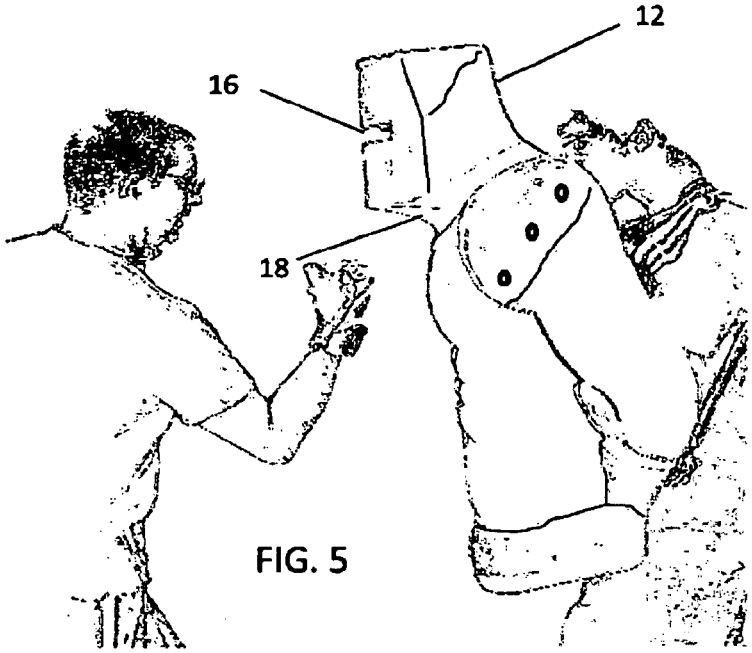
FIG. 5 is a perspective view of the shield like device being held for a trail hand upper cut to the chin like striking area.

The chin like striking area is designed for uppercuts and similar types of strikes labeled 18 in FIGS. 1, 2, 4, 5, 6, and 9 extends anterior to the central body portion of the shield being angled vertically in access of a 90 degree angle as shown in FIGS. 4, 5, 6 and 9 this designed striking area is for vertical attacks such as a boxing uppercut punch as shown in FIG. 5.

Figure 9:
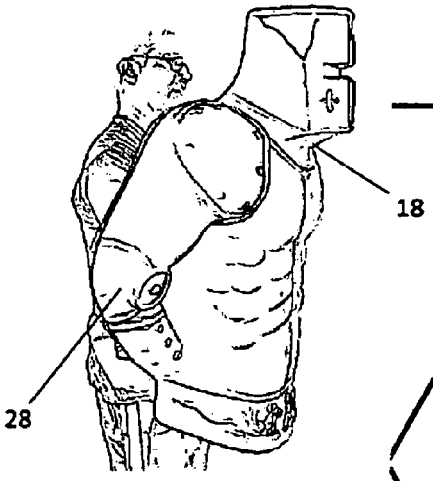
FIG. 9 is a perspective right side view of the second embodiment depicting the shield like device created out of resilient force absorbent foam.
Figure 9A:
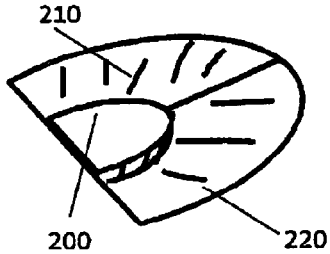
FIG. 9*a* is a perspective enhanced view of the chin like striking area.

FIG. 9*a* shows an expanded view of the chin like striking area having an elevated slope, a convex or concave base portion 200 and multiple extended halves (left 210 and right 220) that are flat with slight outward-upward angle from the center line and extended to provide a contoured target upward chin contact area with a defined striking area designed to assist in providing a solid yet upward sloping shelf that permits vary hard placed uppercuts or kicks appropriate angel of contact.

Figure 6:
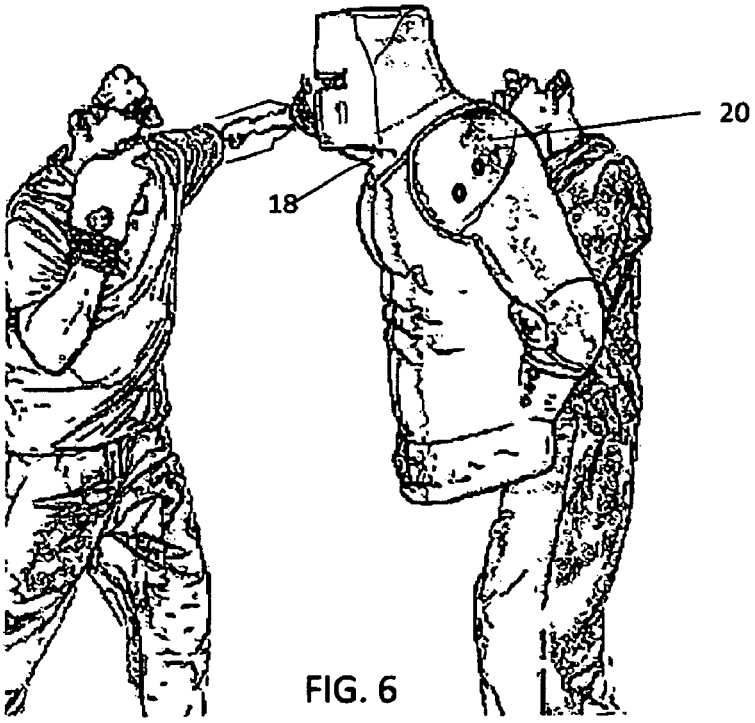
FIG. 6 is a perspective side view of the shield like device being held for a lead hand hook to the dual faceted temple strike area.

The shield like device has shoulder like protrusions 20 as seen in FIGS. 2, 4 and 6 that are essential in providing a realistic transition to striking the head like target area; this is best seen in FIGS. 2 and 6. The shoulder like protrusions, 20 provide an obstacle between the head and rib cage like striking areas 22 as seen in FIG. 4. The shoulder like protrusions assists in defining the difference between the head like protrusion 12 and the rib cage like striking areas 22. The shoulder like protrusions 20, attach the head/helmet like protrusion 12 and to the central striking area 24.

The central striking area 24 as seen in FIGS. 1, 2, 4 are similar to the chest and stomach area of a human in that it has a relatively flat front portion then as one moves laterally from the center line the central striking area shape becomes convex and curves toward the posterior of the shield like device whereby the target area ends as the curve transitions into the rib cage like striking areas 22. The most anterior portion of the central striking area transitions into the uppercut striking area 18. The most ventral portion of the central strike area 24 stops at the belt like band 29. The central striking area 24 bends back to the sides and ends before the concave curve that starts the rib cage striking area as seen in FIG. 13.

The rib cage striking areas 22 as shown in FIGS. 1, 2, 4, 11 and 13 are two bilaterally symmetrical ribcage like pocketed striking areas one on each side of the shield like device. The rib cage striking area 22 is defined by the forward central striking area 24, they are laterally below the shoulder like protrusions 20 and are framed from the posterior edge of the front of the shield like device by the rear sweeping side projections 28 that in the figures are represented as the arms of the knight.

The Belt like band 29 as seen in FIGS. 1, 8 and 12 provide a safety buffer that extends below the limits of the central striking and rib cage like striking areas. This buffer is designed as a safety feature for the person holding the shield like device to protect their crotch and upper leg areas while presenting to the attacker the multiple striking areas. The belt like band is important because it not only assists in defining the striking areas it also provides a safety zone that allows for a greater margin for error when striking as the shield is being moved.

The arm like projections 28 shown in FIGS. 1, 2, 4, 7, 8 and 9 separate the front side striking areas of the shield like device from the back and clearly providing a side safety barrier between the holder and attacker. The arm like projections extend to the side and rear as shown in FIG. 9 and are not intended as striking areas but as safety components designed for the safety of the holder.

The central wall mount attachment point 30 as shown in FIG. 3 is the primary fitting to allow the shield like device to be affixed to a mounting device that will allow the shield like device to be attached to a stationary object such as a wall, post, beam or other fixed point so an individual can use the shield like device 10 without a holder. The attachment points 40 may also be used to supplement the attachment of the shield like device to the mount itself.

FIG. 3.5 shows the shield like device attached to a support arm 60 and attachment mount 61 that can be attached to a beam, wall or other support and used to suspend the shield like device from the central wall mount attachment point 30.

The unique chest contact pedestal 32 as seen in FIGS. 3, 4 and 7. The chest pedestal extends from the back of the shield to contact the chest of the holder. This allows the device to be held at a constant distance taking pressure off the arms while holding the device. The chest contact pedestal also assists in dispersing the power of a blow received into the shield like device 10. The chest contact pedestal provides the spacing for the arms to comfortably grip the handles and creates the space 14 of safety. The chest contact pedestal provides surface contact with the shield like device to allow for better shield control, stability and rigidity to hold the shield device under powerful blows or thrusts from the attacker(s). The Chest contact pedestal is also the central component in the contoured development of the features of the back side of the shield that allow it to be held appropriately.

The arm channel 33 as seen in FIGS. 7 and 8 is located below the handles and provides a hollow for the arms of the holder. The chest contact pedestal also provides the interior bracing points 34 as seen in FIG. 3 that allow the holder to brace the insides of his/her arms against the shield and the outside bracing points 36 as seen in FIGS. 3, 7 and 8. The outside bracing points allow the holder to push against the shield like device with the outside portions of his/her forearms or upper-arms, while holding the shield like device to increase body contact to brace the shield like device and hold it steady against powerful repetitive strikes.

Figure 10A:
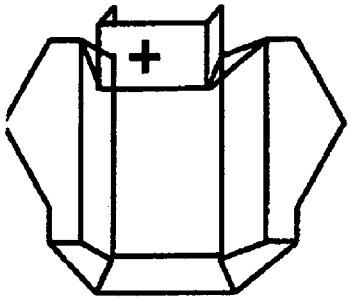
FIG. 10*a* is a perspective front view of the sheet of flexible plastic providing a core material that would be imbedded within the foam bodies of the third and ninth embodiment of the shield like device.
Figure 10B:
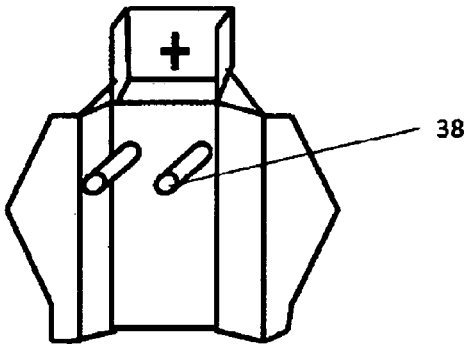
FIG. 10*b* is a perspective back view of the sheet of flexible plastic providing a core material within the foam bodies of the third and ninth embodiment of the shield like device.

The solid handles 38 may be molded within the design of the invention as shown in FIGS. 3, 7 and 8 or attached to the flexible core component as shown in FIG. 10*b*. The handles are designed such that they are solid structures that protrude horizontally, perpendicular to the vertical plane and extend from the rear of the shield like device to allow the holder's hand position, while gripping the shield like device, to be the same hand placement one has in a boxing on-guard-stance.

The shield like device has built in attachment points 40 as seen in FIGS. 3, 7 and 8 for adding one or more bandoleer type support strap(s) that go all the way around the holder lashing him or her to the shield like device to assist the holder in supporting the invention and improve his/her ability to stabilize, support and better control the shield like device.

Accessories attachment point, areas 42 as seen in FIG. 3 is a flat area specifically intended to allow a coach to tape or affix cue cards notes, etc. to the shield like device thereby being able to assist the coach in running a productive training session.

Regarding the various embodiments of the shield like device; the aforementioned points of design are maintained thought the various embodiments of the invention. The difference between the embodiments are the materials that the shield like devices are constructed of and if an integrated impact data device package is or is not used with the embodiment. The contoured striking zones and their geographically location with respect to a human target are always the same.

The reason for the various embodiments of the shield like device is because the composition of a striking target creates desirability for various training activities. A hard target promotes proper application of the attacking tool and alignment of body parts when attacking to fine tune techniques but having a hard target provides an unsafe environment with an inexperienced practitioner. Training can be made safer or enhanced by the composition of the target.

Having multiple embodiments of the same shield like device made of different substances enhances the devices utility. For example, a boxing coach may want a hard target so the boxer can wear extra heavy gloves to strengthen muscles while training. A martial arts instructor teaching small children may desire a resilient soft foam target. Instructors teaching weapons may desire a hard target with removable replaceable components etc. Therefore, the embodiments will be covered individually below.

FIG. 9 shows the second embodiment of the invention created out of resilient force absorbent foam. The features of the shield like device provides safety for the holder and because the device is made totally of a resilient force absorbent foam; or a composition thereof that may or may not be sealed or covered to improve durability and cleanliness. The resilient force absorbent foam design construction would not require the user to wear protective equipment to engage the target with powerful strikes without being harmed by the shield like device. This design would be appealing for working with children.

FIG. 10*a* is a perspective front view and FIG. 10*b* is a perspective back view of the internal flexible plastic core structure that would be the internal structure within the third and ninth embodiments of the shield like device. The third embodiment is a resilient force absorption shield like device with a flexible plastic core component that provides additional firmness and support to the resilient force absorption foam, making the shield like target stiffer in each contoured striking area while being soft enough to provide protection to the person striking the device. The ninth embodiment is the same as the third only includes a data collection transmission package. These embodiments would be useful for karate instructors who are working with advanced students who may want to run drills without requiring them to put on protective gear.

Figure 11:
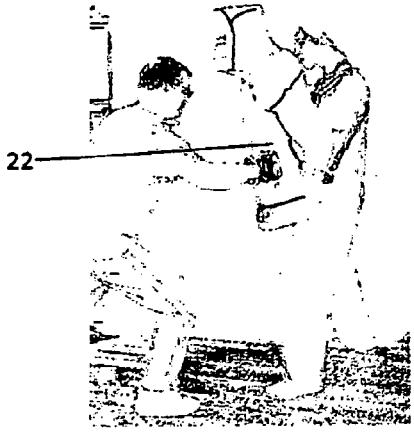
FIG. 11 is a perspective side view of a low hook to the left rib like striking area on a third embodiment depicting the shield like device supported with bandoleer straps created of a hard non-force absorbent material.

FIG. 11 is a perspective view of the fourth embodiment depicting the shield like device that is created of a hard non-force absorbent material. This embodiment would be constructed of plastic, fiber-reinforced plastic or lightweight non-flexing metal. This type of shield like device is ideal for boxing coaches who desire their students to wear extra heavy gloves to improve muscle use and work on proper contact with the target or MMA practitioners who are working on developing toughness and strength in their attacking tools while working on striking.

FIG. 12 is a perspective front view of a fifth embodiment depicting the shield like device created of a hard non-force absorbent material with a foam filled portion between the front and back of the shield like device to increase the rigidity and durability of the device to be able to withstand heavy surface impacts. This embodiment would be an excellent choice for martial arts instructors or law enforcement personnel who want to use the shield like device for weapons training.

FIG. 13 is a perspective front view of a sixth embodiment which is any of the previous embodiment types now having removable force absorbent contoured striking areas that can be replaced if torn, damaged or worn out. FIG. 13*a* is a close up view of a removed right rib cage striking area. The figure shows that the striking area is constructed of thick foam or rubber/durable force absorbent material that inserts into the appropriate striking area. This type of design would have utility with military forces, law enforcement or MMA fighters who are focusing on targeting specific areas of a person's body.

The eighth embodiment is a shield like device made of resilient force absorbent foam as described in the second embodiment with the addition of the data collection transmission package FIG. 14*a*, FIG. 14*b*, FIG. 14*c* and FIG. 14*d* are various perspectives of the resilient force absorbent shield like device with on-board integrated impact data device package components.

FIG. 14*a* is a perspective right side view showing user side data display 160. Note: the data displays on the front and back are in the same configuration.

FIG. 14*b* is a perspective view of the back side of the shield like device showing the on-board integrated impact data device package main unit and backside user data display 300. The integrated impact data device main unit is behind the facing of the backside user data display 300.

Figure 14C:
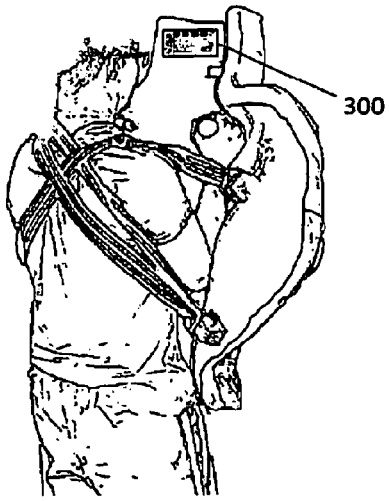
FIG. 14*c* is a perspective back right view of the eighth embodiment depicting the shield like device being held that is created out of a resilient force absorbent foam like material with full a data collection transmission package and on-board integrated impact data device package showing the holder data display with light array.

FIG. 14*c* is a perspective backside right side view showing the integrated impact data device package main unit and backside user data display 300.

Figure 14D:
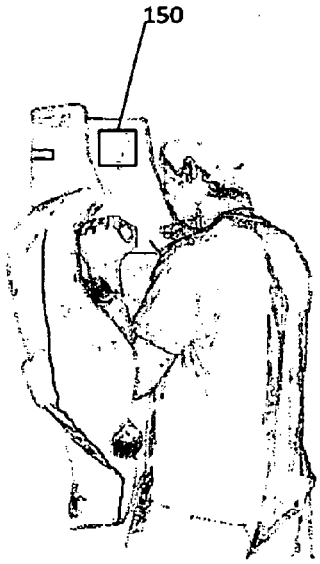
FIG. 14*d* is a perspective back left view the eighth embodiment depicting the shield like device being held that is created out of a resilient force absorbent foam like material with a data collection transmission package and on-board integrated impact data device package showing a data system speaker.

FIG. 14*d* is a perspective back left side view showing the speaker system 150.

Figure 15:
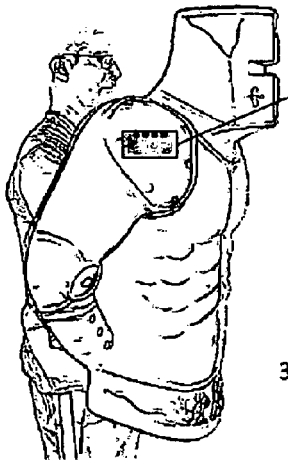
FIG. 15 is a perspective front right view of the ninth embodiment depicting the shield like device created out of a resilient force absorbent foam with a flexible core component supporting the resilient force absorption material with contoured striking areas for the attacker to strike, with data collection transmission package and on-board integrated impact data device package.

The ninth embodiment FIG. 15 is a resilient force absorbent foam shield like device with a flexible component core showing the user side data display 160.

Figure 15A:
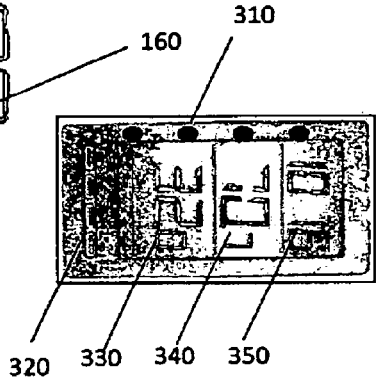
FIG. 15*a* shows an expanded view of the user side data display: input buttons, clock, power, speed displays and light array.

FIG. 15*a* shows an expanded view of the data display 160 with various subcomponents: light array 310 consisting of various color lights that span the top of the data display that can be associated with impact force data to light correspondingly as the target area is struck to provide a visual reference of performance, 320 is the button input to allow data to be put in at the shield like device during use, 330 is the timer display, 340 is the force reading display, and 350 is the speed reading display.

The tenth embodiment is a shield like device constructed of a hard non-force absorbent material not intended to provide a force absorbing safety surface for the attacker to strike with a hollow between the front and back of the shield like device with data collection transmission package. This will provide a light highly mobile hard target with data capture capabilities.

The eleventh embodiment is a shield like device constructed of a hard non-force absorbent material that is foam filled between the front and back of the shield like device that increases the rigidity and durability of the front of the device allowing the material to be even more durable and withstand more punishment while being able to be securely held. The eleventh embodiment would also be equipped with data collection transmission package.

The twelfth embodiment is any of the previously detailed embodiments with or without exterior covering having: removable force absorbent contoured striking areas that can be replaced if torn, damaged or worn out with a data collection transmission package that will communicate digitally with either the on-board integrated impact data device package or the detached data management pylon.

Figure 16:
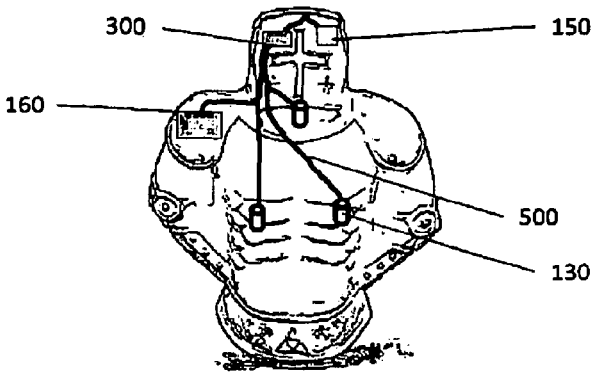
FIG. 16 shows the concept of wiring from the impact sensors to the data collection transmission package found in embodiments seven through twelve.

FIG. 16 shows the concept of wiring and placement data collection transmission package main unit (collocated with the user data display) and on-board integrated impact data device package backside user data display 300, speaker system 150, user side data display 160, digital impact sensors 130, and internal wiring harness 500 connecting the digital components. FIG. 16 shows the components of the integrated impact data device package which would be found in embodiments seven through twelve.

Figure 16A:
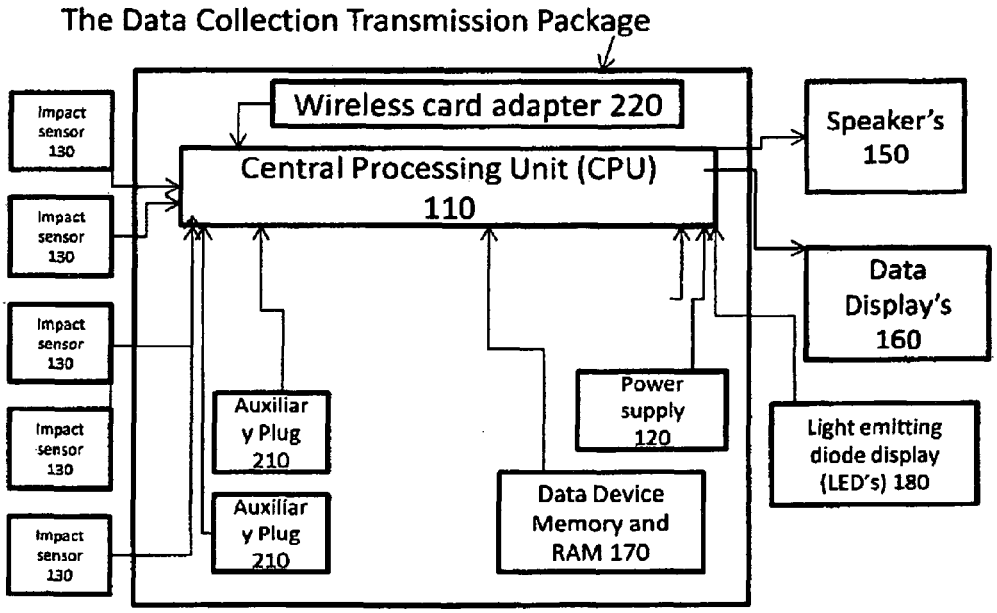
FIG. 16*a* is a block diagram showing the circuitry of the data collection transmission package.

FIG. 16*a* is a block diagram showing the component pieces of the data collection transmission package.

Figure 17:
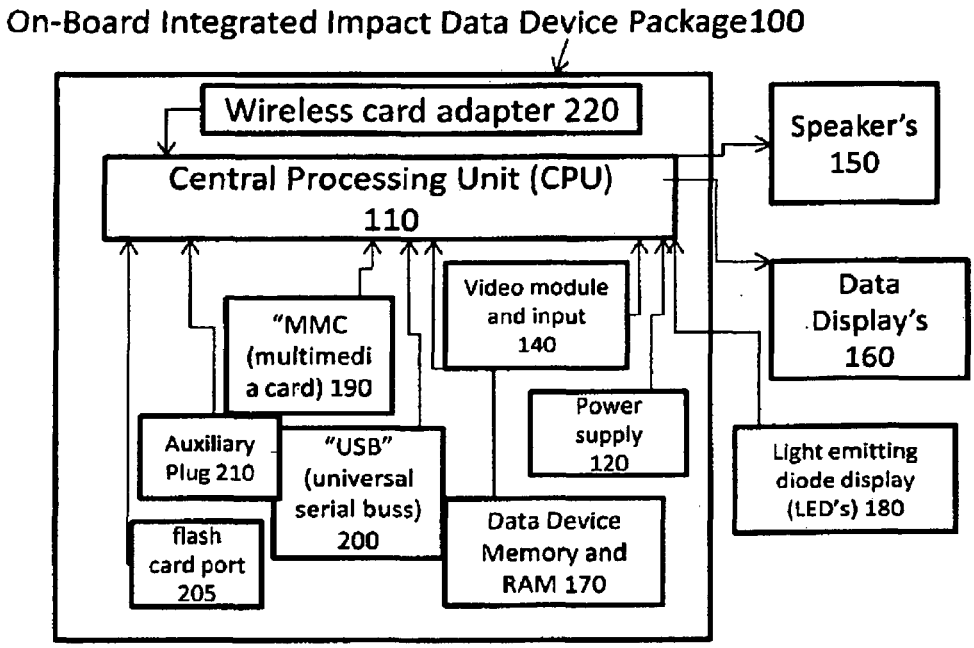
FIG. 17 is a block diagram showing the circuitry of the on-board integrated impact data device package.

FIG. 17 is a block diagram showing the component pieces of the on-board integrated impact data device package 100 which is collocated with a user and back side data display 160. The intent of the data package is to provide a means for digital communication (wire and wireless transmission) and said usage of the data by a program that will allow use of the data to be used by the individual to look at power, speed and timing of strikes and combinations thereof, to compare data of various personal workouts and compare data to that of other individuals and to be able to use data on the internet with both audio and video all being connected to and collected by the current invention. The on-board integrated impact data device package 100 central processing unit (CPU) 110 communicates with: multiple digital impact sensors 130, with one or more video modules 140 that would be hooked into with an external camera, one or more speaker units 150, one or more data display's 160, the power supply 120 can include a 120-volt power supply (AC/DC converter or a self-contained battery pack, the Data Device Memory and RAM 170, the Light emitting diode control (LED's) 180, "MMC (multimedia card) 190, "USB" (universal serial bus) 200, Auxiliary Plug 210 which will provide multiple plug in options such as input jacks or a flash card port. This attachment point is to support various technologies for wire transfer of data, Wireless card adapter 220 for wireless contact with the integrated impact data device package 100, CPU 110. The CPU 110 can also integrate and support a heart-rate monitor (not shown) via installing an appropriate program. A wireless connection can be established and real-time data can be displayed, collected, stored and integrated into the performance information readout.

Figure 18:
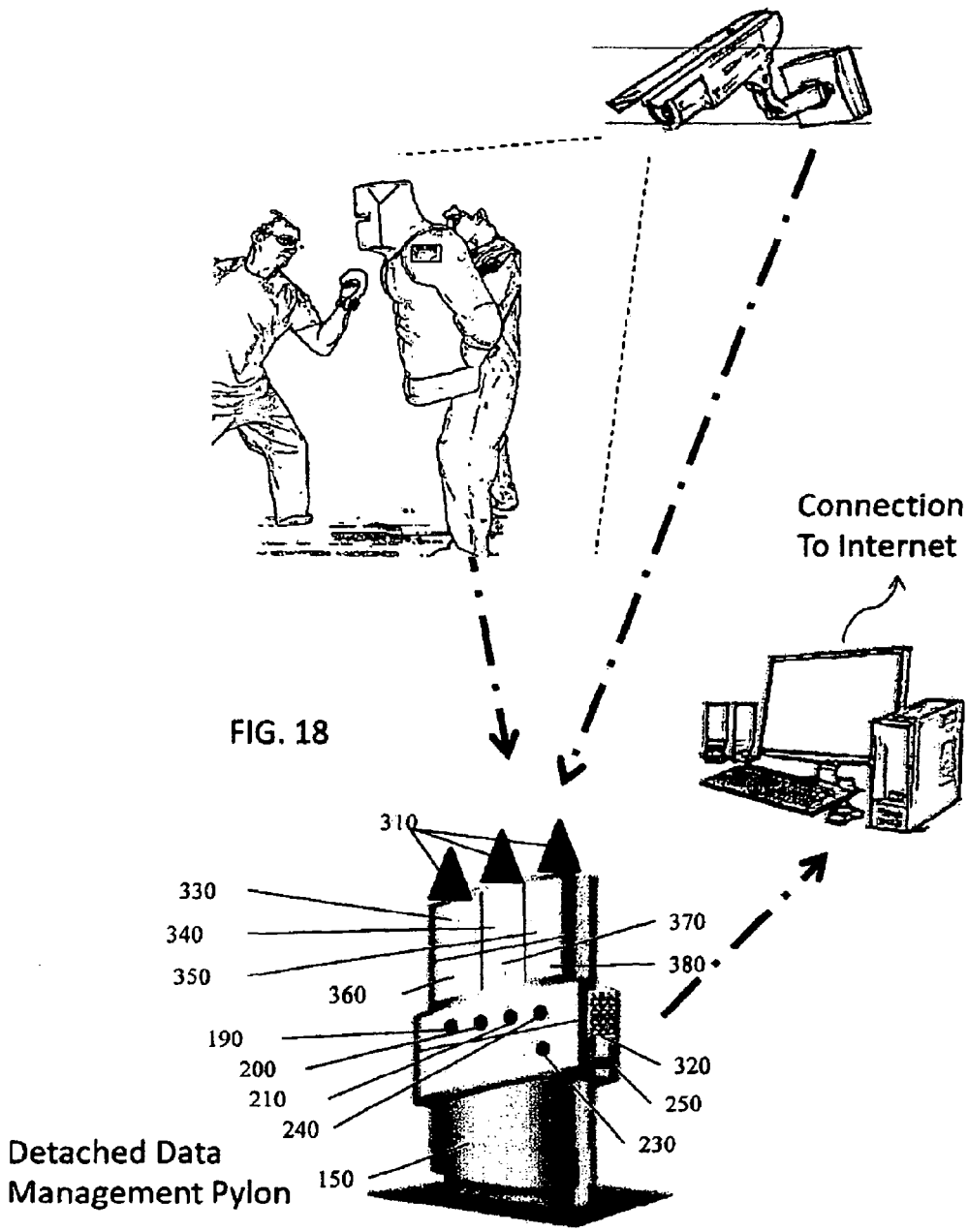
FIG. 18 is a block diagram showing an embodiment of the shield like device having the data collection transmission package communicating with the detached data management pylon and associated devices.

FIG. 18. FIG. 18 shows the detached data management pylon receiving data from the data collection transmission package of the shield like device and an auxiliary camera. The detached data management pylon shown here is receiving data from only one shield like device. It would then provide sound, light and audio feedback for the one shield like device. The data would then be collected and then sent to the gym computer either wirelessly or via wire. The detached data management pylon shown has the following features: light array 310 consisting of various color lights that span the top, 320 is the button input to allow data added at the control of the shield like device or at the pylon, 330 is the timer display, 340 is the force reading display, 350 is the speed reading display, 360 is the heart rate display, 370 is the caloric burn display, 380 is a clock, "MMC (multimedia card) 190, "USB" (universal serial bus) 200, Auxiliary Plug 210 which will provide multiple plug in options such as audio input jacks, 230 is a flash card port, 240 video Jack, 150 speaker jacks, 250 magnetic card reader.

Typically, the shield like device ranges in thickness from about two inches thick to several inches in thickness from the front of the shield like device to the back of the chest contact pedestal 32. The shield like device can be made of one piece or assembled together out of several pieces, using conventional techniques such as fasteners, welding, or in the case of plastics: solvent welding, gluing, casting or a combination thereof.

It should be apparent that the shield device described hereinabove, possesses each of the attributes set forth in the aforementioned text. Some attributes can be modified to some extent without departing from the principles as outlined and explained in this specification. It should be understood that the present invention encompasses all such modifications as are within the spirit and scope of the aforementioned claims, summary and detailed description.

There are in existence a number of training devices designed to be punched or kicked etc. to assist in the training of the fighting arts. The field provides: hand held pads, shields, anatomically correct rubber dummies, pedestal mounted dummies, bag like dummies and large multi station interactive personal training devices and mobile interactive personal training devices. The prior art has some general similarities however; the current invention is unique in its construct, design, embodiments and options of embodiments in the following ways.

The invention claimed is:

1. A martial arts shield-like training device which is held in front of a holder's body to provide protection while presenting contoured striking surfaces for an attacker to strike comprising:

a head-like striking area having at least one vision port allowing vision from a back of the shield-like training device to a front of the shield-like training device so that the holder carrying the shield-like training device can visibly observe the attacker at close proximity without risk of injury, said vision port comprising a slot and/or a clear material, similar in function to a window, affixed to or contained within the head-like striking area;

contoured shoulder-like protrusions;

a belt-like band below the contoured shoulder-like protrusions;

a central striking area having a flat portion with bilateral symmetry disposed between the contoured shoulder-like protrusions and a top of the belt-like band, the central striking area representing a chest and stomach of an opponent;

two bilaterally symmetrical ribcage-like striking areas extending horizontally from distal edges of the central striking area and extending vertically between the belt-like band and a bottom edge of a corresponding contoured shoulder-like protrusion; and two bilaterally symmetrical side projections extending vertically between a distal edge of a corresponding contoured shoulder-like protrusion and the top of the belt-like band, the side projections providing a safety barrier between the holder and attacker.

2. The shield-like training device of claim 1, wherein the head-like striking area is set forward of the central and ribcage-like striking areas to create a safety space between the face of the holder and the back of the shield-like training device so that the holder is not injured when the shield-like training device is struck by an attacker.

3. The shield-like training device of claim 1, wherein the head-like striking area further comprises:

a front face contoured striking surface containing the vision port and having from one to three faceted faces providing angular relief;

two temple-like side surfaces each containing at least one facet designed to be struck at a 90 degree angle;

a flat top portion to receive downward strikes from the attacker; and an angled, chin-like uppercut striking area extending horizontally from a throat-like area, said uppercut striking area having two bilaterally symmetrical striking surfaces.

4. The shield-like training device of claim 1, further comprising a wall mount attachment point so that the shield-like training device can be affixed to a mount, said wall mount attachable to a wall, post, or beam.

5. The shield-like training device of claim 1, further comprising a chest contact pedestal, said chest contact pedestal built into the back of the shield-like training device and allowing the holder to increase chest surface contact with the shield-like training device to allow for better control of the shield-like training device when subjected to attacks from the attacker.

6. The shield-like training device of claim 1, wherein the two bilaterally symmetrical side projections project rearward of the ribcage-like and head-like striking areas to protect the upper body of the holder while not detracting from the attacker's ability to strike the head-like or ribcage-like striking areas.

7. The shield-like training device of claim 1, further comprising bracing point areas ergonomically designed to increase the holder's body surface contact area with the back of the shield-like training device, the bracing point areas allowing the holder to push against the back of the shield-like training device with a portion of the holder's forearm, upper torso or shoulders to brace the shield-like training device against powerful and repetitive strikes from the attacker.

8. The shield-like training device of claim 1, further comprising sturdy, built-in handles protruding from the back of the shield-like training device to allow the holder to grip the shield-like training device in a defensive boxing on-guard stance, wherein the handles are not sewn in to the device or made of straps.

9. The shield-like training device of claim 1, wherein an outer surface and body of the shield-like training device maybe be made of the same materials, said materials comprising rubber, foam, plastic, leather, vinyl, and canvas.

10. The shield-like training device of claim 1, wherein the shield-like training device is made of foam or layers of foam.

11. The shield-like training device of claim 1, further comprising replaceable inserts to change the hardness, resilience, and force absorption properties of the shield-like training device.

12. The shield-like training device of claim 1, further comprising a data collection transmission package inside the shield-like training device, said data collection transmission package comprising: digital data storage, impact sensors, applicable wiring, digital software on a computer readable media, and data transmission components; wherein the data collection transmission package communicates with an on-board board integrated impact data device package and a detached data management pylon.

13. The shield-like training device of claim 12, wherein the on-board integrated impact data device package further comprises:

a central processing unit;

one or more digital impact sensors;

one or more video modules;

one or more speaker units;

one or more digital data displays;

a 120-volt power supply AC/DC converter or a self-contained battery pack;

data device memory;

random access memory;
a light emitting diode display;
an auxiliary plug for attaching audio, video, or heart monitoring equipment;
a wireless card adapter; and
a flash card port;
said impact data device package capable of:
receiving data from the data collection transmission package,
allowing digital collection of information from the one or more impact sensors and one or more video modules, and
providing real-time feedback through the one or more speaker units, light emitting diode display, and one or more digital data displays to create an interactive training device where the received data can be stored, tracked, and compared using a computer or network of computers.

14. The shield-like training device of claim 12, wherein the detached data management pylon further comprises:
a central processing unit;
one or more digital impact sensors;
one or more video modules;
one or more speaker units;
one or more digital data displays;
a 120-volt power supply AC/DC converter or a self-contained battery pack;
data device memory;
random access memory;
a light emitting diode display;
an auxiliary plug for attaching audio, video, or heart monitoring equipment;
a wireless card adapter; and
a flash card port;
said detached data management pylon capable of:
receiving data from the data collection transmission package,
allowing digital collection of information from the one or more impact sensors and one or more video modules, and
providing real-time feedback through the one or more speaker units, light emitting diode display, and one or more digital data displays to create an interactive training device where the received data can be stored, tracked, and compared using a computer or network of computers; and
wherein the data collection transmission package is placed a distance away from the shield-like training device so that the holder and attacker can see the light emitting diode display and one or more digital data displays and hear the one or more speaker units.

15. The shield-like training device of claim 12, wherein data can be compared in a competition and a comparison can be made between individual scores, individual composite scores, and facility total scores.

16. The shield-like training device of claim 1, wherein identification of the attacker can be made at the device by an electronic card reader, RFID card reader, or punch code on a key pad.

17. The shield-like training device of claim 1, further comprising: a pre-set round indicator having 2, 3, and 6 minute settings, designated rest settings of 30 seconds and 1 minute, as well as beginner, intermediate, and professional settings indicated by lights and audio.

* * * * *